US010542773B2

(12) United States Patent
Guyard et al.

(10) Patent No.: US 10,542,773 B2
(45) Date of Patent: Jan. 28, 2020

(54) HYDROPHOBIC PAPER

(71) Applicant: PHILIP MORRIS PRODUCTS S.A., Neuchatel (CH)

(72) Inventors: Aurelien Guyard, Pompaples (CH); Ping Li, Lausanne (CH); Gianluca Sechi, Colombier (CH)

(73) Assignee: Philip Morris Products S.A., Neuchatel (CH)

( * ) Notice: Subject to any disclaimer, the term of this patent is extended or adjusted under 35 U.S.C. 154(b) by 268 days.

(21) Appl. No.: 14/905,901

(22) PCT Filed: Jul. 17, 2014

(86) PCT No.: PCT/IB2014/063195
§ 371 (c)(1),
(2) Date: Jan. 18, 2016

(87) PCT Pub. No.: WO2015/008253
PCT Pub. Date: Jan. 22, 2015

(65) Prior Publication Data

US 2016/0157519 A1 Jun. 9, 2016

Related U.S. Application Data

(60) Provisional application No. 61/856,128, filed on Jul. 19, 2013.

(30) Foreign Application Priority Data

Jul. 19, 2013 (EP) ..... 13177181

(51) Int. Cl.
*A24D 1/02* (2006.01)
*A24D 1/00* (2006.01)
(Continued)

(52) U.S. Cl.
CPC ..... *A24D 1/02* (2013.01); *A24D 1/002* (2013.01); *A24F 47/006* (2013.01); *D21H 21/16* (2013.01)

(58) Field of Classification Search
CPC ..... A24D 1/02
See application file for complete search history.

(56) References Cited

U.S. PATENT DOCUMENTS 4,341,228 A 7/1982 Keritsis et al.
4,784,164 A * 11/1988 Adams ..... A24D 1/02 131/336

(Continued)

FOREIGN PATENT DOCUMENTS

EP 0200755 B1 5/1989
EP 0 758 532 A2 2/1997

(Continued)

OTHER PUBLICATIONS

International Search Report and Written Opinion of PCT/IB2014/063195, dated Sep. 30, 2014; 7 pgs.

(Continued)

*Primary Examiner* — Eric Yaary
(74) *Attorney, Agent, or Firm* — Mueting, Raasch & Gebhardt P.A.

(57) ABSTRACT

A smoking article includes a tobacco substrate and a wrapper disposed about the tobacco substrate. At least an inner or outer surface of the wrapper is hydrophobic via hydrophobic groups chemically bonded to the wrapper. The wrapper has a permeability of at least about 15 CORESTA units.

18 Claims, 2 Drawing Sheets

(51) Int. Cl.

| | |
|---|---|
| ***A24F 47/00*** | (2006.01) |
| ***D21H 21/16*** | (2006.01) |

(56) References Cited

U.S. PATENT DOCUMENTS

| | | | | |
|---|---|---|---|---|
| 5,143,099 | A * | 9/1992 | Le Gars | A24D 1/02 131/331 |
| 5,263,999 | A * | 11/1993 | Baldwin | A24D 1/025 131/365 |
| 5,374,335 | A | 12/1994 | Lindgren et al. | |
| 5,584,306 | A | 12/1996 | Beauman et al. | |
| 5,724,998 | A | 3/1998 | Gellatly et al. | |
| 5,776,347 | A | 7/1998 | Lindgren et al. | |
| 6,216,706 | B1 | 4/2001 | Kumar et al. | |
| 6,342,268 | B1 | 1/2002 | Samain | |
| 6,598,607 | B2 | 7/2003 | Adiga et al. | |
| 8,637,119 | B2 | 1/2014 | Stinga et al. | |
| 2003/0073363 | A1* | 4/2003 | Ono | 442/153 |
| 2003/0075188 | A1 | 4/2003 | Adiga et al. | |
| 2003/0131860 | A1 | 7/2003 | Ashcraft et al. | |
| 2003/0136420 | A1* | 7/2003 | Kraker | A24C 5/005 131/360 |
| 2003/0219580 | A1* | 11/2003 | Tagge | C04B 18/28 428/292.1 |
| 2004/0134631 | A1* | 7/2004 | Crooks | A24D 1/025 162/139 |
| 2004/0159414 | A1 | 8/2004 | Durhammer | |
| 2005/0000533 | A1 | 1/2005 | Yamada et al. | |
| 2008/0269390 | A1 | 10/2008 | Weitzel | |
| 2009/0098652 | A1* | 4/2009 | Stupp | C07K 7/06 435/455 |
| 2009/0165976 | A1* | 7/2009 | Soane | 162/164.6 |
| 2011/0014458 | A1 | 1/2011 | Stinga et al. | |
| 2011/0030709 | A1 | 2/2011 | Sebastian et al. | |
| 2011/0230635 | A1 | 9/2011 | Lee et al. | |
| 2012/0103546 | A1 | 5/2012 | Maniere | |
| 2012/0138249 | A1 | 6/2012 | Sundholm et al. | |
| 2012/0298126 | A1 | 11/2012 | Dyakonov et al. | |
| 2013/0123485 | A1 | 5/2013 | Park et al. | |
| 2014/0161974 | A1* | 6/2014 | Erho | B41M 3/005 427/145 |

FOREIGN PATENT DOCUMENTS

| | | | |
|---|---|---|---|
| EP | 1 044615 | A1 | 10/2000 |
| EP | 1007202 | B1 | 4/2001 |
| JP | S63501224 | A | 5/1988 |
| JP | H08-506628 | A | 7/1996 |
| JP | 2005506080 | A | 3/2005 |
| JP | 4044731 | B2 | 2/2008 |
| JP | 2009-513759 | A | 4/2009 |
| JP | 4520745 | B2 | 8/2010 |
| JP | 2013-501164 | A | 1/2013 |
| KR | 10060154200000 | | 7/2006 |
| KR | 1006362870000 | | 10/2006 |
| WO | WO 99/38396 | A1 | 8/1999 |
| WO | WO 99/53778 | A2 | 10/1999 |
| WO | WO 1999/064934 | A1 | 12/1999 |
| WO | WO 03/077687 | A2 | 9/2003 |
| WO | WO 2009/083525 | A1 | 7/2009 |
| WO | WO 2011/154697 | A1 | 12/2011 |
| WO | WO 2012/044042 | | 4/2012 |

OTHER PUBLICATIONS

"Surface wettability and absorbency of sheeted materials using an automated contact angle tester," T 558 om-97—Provisional Method—1995—Official Method—1997; Approved by the Physical Properties Committee of the Process and Product Quality Division TAPPI ( 10 pgs.

Baker and Crellin, "The Diffusion of Carbon Monoxide out of Cigarettes," *Beitrage zur Tabakforschung*, Oct. 1997; 9(3):131-140.

International Preliminary Report on Patentability of PCT/IB2014/063195, issued by the International Bureau of WIPO, dated Jan. 28, 2016; 5 pgs.

Japanese Office Action For JP 2016-526747, including English Translation, dated Jun. 4, 2018; 20 pgs.

"Paper Chemicals," Zhang Guanghua, China Petrochemical Press, 1st edition, Dec. 2000; p. 250 and pp. 252-254 "Reactive Waterproofing Agents": 13 pgs.

Chinese Office Action, issued by the State Intellectual Property of the People's Republic of China for Application No. 201480040028.6 dated Sep. 26, 2018; 18 pgs. (Including English Translation).

"Preparation of methyl benzoate," Engineer, JAM' S BLOOOOG, Feb. 6, 2013; Korean; Machine Translated into English—8 pgs.

Wang et al., "Design and Development of Anti-Icing Aluminum Surface," *Materials Sciences and Applications*, 2013;4:347-356.

* cited by examiner

HYDROPHOBIC PAPER

This application is the § 371 U.S. National Stage of International Application No. PCT/IB2014/063195, filed 17 Jul. 2014, which claims the benefit of U.S. Provisional Application No. 61/856,128, filed 19 Jul. 2013 and European Application No. 13177181.8, filed 19 Jul. 2013, each of which are incorporated by reference herein in their entireties.

The present disclosure relates to paper used in smoking articles, such as a cigarette wrapper, wherein the paper has a hydrophobic surface.

Combustible smoking articles, such as cigarettes, have shredded tobacco (such as tobacco cut filler) surrounded by a paper wrapper forming a tobacco rod. A cigarette is employed by a consumer by lighting one end thereof and burning the shredded tobacco rod. The smoker then receives mainstream smoke into their mouth by drawing on the mouth end or filter end of the cigarette.

A number of smoking articles in which tobacco is heated rather than combusted are known. Such heated smoking articles are believed to reduce known harmful smoke constituents produced by the combustion and pyrolytic degradation of tobacco in conventional cigarettes. Typically in these heated smoking articles, an aerosol is generated by the transfer of heat from a heat source to a tobacco-based aerosol-generating material, which may be located within or separately from the heat source. In use, the heat source of the heated smoking article is activated and volatile compounds are released from the tobacco-based aerosol-generating material by heat transfer from the heat source. These volatile compounds are entrained in air drawn through the heated smoking article. As the released compounds cool, they condense to form an aerosol which is inhaled by the consumer.

Many smoking articles generally comprise a filter aligned in end-to-end relationship with a tobacco rod. Some smoking articles include a filter segment with functional materials that capture or convert components of the mainstream smoke or aerosol as the mainstream smoke or aerosol is being drawn through the filter. Such functional materials are known and include, for example, sorbents, catalysts and flavourant materials.

The concentration of carbon monoxide ("CO") in the mainstream smoke can be dependent at least in part on the porosity of the wrapper surrounding the shredded tobacco. The porosity of this wrapper may affect the amount of dilution air entering the tobacco rod through the cigarette wrapper, or the porosity may affect the amount of diffusion of CO out of the tobacco rod through the wrapper, or it may affect some combination of both dilution and diffusion.

The concentration of CO in each puff of the cigarette mainstream smoke generally increases with each incremental puff count. This may be due, at least in part, to a decrease in the remaining cigarette wrapper surface area for the above described dilution or diffusion.

It would be desirable to provide a smoking article that reduces an amount of CO in mainstream smoke. It would also be desirable to maintain the highest possible CO diffusion rate or air dilution rate through the cigarette wrapper as the tobacco substrate is consumed.

Paper that is included in smoking articles can absorb water along with other compounds found in the mainstream smoke or aerosol passing through the smoking article or humidity or moisture surrounding the paper. This absorbed water and other compounds can stain or weaken the paper and negatively affect the smoking article.

It would be desirable to provide a smoking article that included paper that did not readily absorb water or compounds found in the mainstream smoke or aerosol passing through the smoking article or found in the environment surrounding the paper. It would also be desirable that this hydrophobic paper not affect the taste of the smoke or aerosol generated by the smoking article.

According to a first aspect of the invention, a smoking article includes a tobacco substrate and a wrapper disposed about the tobacco substrate. At least an inner or outer surface of the wrapper is hydrophobic via hydrophobic groups chemically bonded to the wrapper. The wrapper has a permeability of at least about 15 CORESTA units. The invention also encompasses a smoking article comprising a wrapper wherein the inner and outer surfaces both exhibit hydrophobic properties and a permeability of at least 15 CORESTA units.

Smoking articles that include a permeable wrapper with a hydrophobic surface (preferably the inner surface is hydrophobic) can better maintain the CO diffusion rate or air dilution rate through the wrapper as the tobacco substrate is consumed. As a result, the overall amount of CO in the mainstream smoke may be reduced.

Smoking articles that include a permeable hydrophobic wrapper can resist water absorption onto the wrapper portion of the smoking articles. As a result, visible staining and physically weakening the wrapper portion of the smoking article may be reduced.

Combustible smoking articles such as cigarettes include a tobacco substrate that is wrapped with a wrapper. The tobacco substrate includes a rod of tobacco formed of tobacco, shredded tobacco or tobacco cut filler or a combination thereof. The tobacco substrate produces mainstream smoke when the tobacco rod is burned or otherwise consumed.

Heated smoking articles include a tobacco substrate that is also enclosed with a wrapper. The tobacco substrate includes a rod of tobacco formed of tobacco, shredded tobacco or tobacco cut filler or a combination thereof and a heat source. The tobacco substrate produces an aerosol of volatile compounds released from the heated tobacco substrate upon use of the heated smoking article.

The tobacco substrate includes a rod of tobacco formed of shredded tobacco or tobacco cut filler like cigarettes, or it may include reconstituted tobacco or cast leaf tobacco, or a mixture of both. The term "reconstituted tobacco" refers to paper-like material that can be made from tobacco by-products, such as tobacco fines, tobacco dusts, tobacco stems, or a mixture of the foregoing. Reconstituted tobacco can be made by extracting the soluble chemicals in the tobacco by-products, processing the leftover tobacco fibers from the extraction into a paper, and then reapplying the extracted materials in concentrated form onto the paper. The term "cast leaf tobacco" is used herein to refer to a product resulting from a process that is well known in the art, which is based on casting a slurry comprising ground tobacco particles and a binder (for example, guar) onto a supportive surface, such as a belt conveyor, drying the slurry and removing the dried sheet from the supportive surface. Exemplary methods for producing these types of tobacco substrate or aerosol-generating substrates are described in U.S. Pat. Nos. 5,724,998; 5,584,306; 4,341,228; 5,584,306 and 6,216,706. Hence, the term tobacco substrate as used herein refers to various types of tobacco products including, but not limited to, shredded tobacco, cut filler, reconstituted tobacco and cast leaf tobacco.

The present disclosure provides a wrapper having only a hydrophobic inner surface or at least a hydrophobic inner surface; a wrapper having only a hydrophobic outer surface or at least a hydrophobic outer surface; or a wrapper having both a hydrophobic inner surface and a hydrophobic outer surface. Without being bound by any particular theory, it is thought that particulate matter (tar) deposits on the inside surface of the cigarette wrapper, and that this deposition of the tar on the inner surface decreases the porosity of the paper as the tobacco inside the cigarette wrapper is burned and consumed. It is thought that the hydrophobic inner surface of the cigarette wrapper inhibits tar deposition to maintain the permeability of the cigarette wrapper during the smoking process. Since the permeability is maintained at a higher level, the CO diffusion rate or air dilution rate through the cigarette wrapper is maintained at a higher level during the smoking process, which in turn can reduce CO in mainstream smoke.

It is also contemplated that the hydrophobic inner surface or at least a hydrophobic inner surface or a hydrophobic inner surface and a hydrophobic outer surface of a wrapper reduces and prevents the formation of spots on a smoking article that are visible to a consumer. It has been observed that spots appear on a smoking article upon storage where the tobacco substrate is exposed to humid conditions or moisture. The spots are caused by absorption of water, including any coloured substances that are suspended or dissolved, into the web of cellulosic fibers that constitutes the paper wrapper. Without being bound by any theory, the water interacts with the cellulosic fibers of the paper and alters the organization of the fibers resulting in a local change in the optical properties, such as brightness, color, and opacity, and mechanical properties, such as tensile strength, permeability of the paper wrapper.

The wrapper (or paper) is the portion of the smoking article that is disposed about the tobacco rod or tobacco material or the cut filler to help maintain the cylindrical form of the tobacco substrate. This paper can exhibit a wide range of permeability. Permeability of cigarette paper is determined by utilizing the International Standard test method ISO 2965:2009 and the result is presented as cubic centimetres per minute per square centimetre and referred to as "CORESTA units".

The permeability of an untreated wrapper (that is, with no hydrophobic treatment) can be about 15 CORESTA units or greater, about 20 CORESTA units or greater, more preferably about 30 CORESTA units or greater or most preferably about 40 CORESTA units or greater. In some configurations, the permeability of the untreated wrapper is in a range from about 15 to about 100 CORESTA units, about 20 to about 200 CORESTA units or from about 30 to about 130 CORESTA units or from about 40 to about 80 CORESTA units.

The wrapper can be formed of any suitable material. In many embodiments the wrapper is formed of a material with pendent hydroxyl groups. Material with pendent hydroxyl groups includes cellulosic material such as paper. The wrapper can also include one or more filler materials, for example calcium carbonate. The term "wrapper" as used herein encompasses "paper wrapper", "cigarette wrapper", as well as any wrapper used to enclose and form a heated smoking article or combustible smoking article, and particularly the tobacco substrate.

A wrapper of the invention, including any hydrophobic treatments, can have any suitable basis weight. The basis weight of a wrapper can be in a range from about 20 to about 50 grams per square meter or from about 20 to about 40 grams per square meter. A wrapper can have any suitable thickness. The thickness of a wrapper can be in a range from about 30 to about 80 micrometres or from about 30 to about 60 micrometres, or from about 40 to 50 micrometers.

In many embodiments, the thickness of the wrapper allows the hydrophobic groups or reagent applied to one surface to spread onto the opposing surface effectively providing similar hydrophobic properties to both opposing surfaces. In the example provided below, the thickness of the wrapper was about 43 micrometres and both surfaces were rendered hydrophobic by the gravure process using stearoyl chloride as the hydrophobic reagent to one surface. Accordingly, although many of the benefits of the invention only requires that one of the two major surfaces, that is, either the inner surface or the outer surface, exhibits the hydrophobic properties, it is contemplated that paper which exhibits hydrophobic properties on both major surfaces can also be used similarly. Therefore, the invention encompasses various applications in which the wrapper comprises at least one hydrophobic surface.

While not being bound by any particular theory, it is believed that the tar component of the mainstream smoke deposits on the surface and in the pores of the wrapper and reduces or inhibits the permeability of the wrapper during the use of the smoking articles. Thus, inhibiting tar deposition on the wrapper may reduce CO concentration in mainstream smoke by maintaining the diffusion of CO out of the smoking article through the wrapper or by maintaining dilution air entering the mainstream smoke through the wrapper, or by maintaining both diffusion of CO out of the smoking article and dilution air entering the mainstream smoke through the wrapper.

A hydrophobic surface can inhibit the deposition of tar on the wrapper and help maintain the permeability of the wrapper during the consumption or use of the smoking article. The hydrophobic surface is preferably the inner surface of the wrapper, but in some embodiments both the inner and outer surfaces of the wrapper can be hydrophobic.

The hydrophobic surface of a wrapper can also inhibit the transfer, absorption and accumulation of water and other substances to the wrapper that can form visible spots on the wrapper of smoking articles. Essentially, the hydrophobic surface reduces or prevents the staining of the wrapper by water and other substances.

The hydrophobic wrapper can also inhibit the transfer, absorption and accumulation of water and staining of the wrapper that occurs when the smoking article is stored or utilized in a humid environment, particularly where the humidity is very high (e.g., relative humidity greater than 70%, 80%, 90%, 95%, 99%) or when the smoking article is stored for an extended period, (e.g., more than three weeks, two months, three months, or six months), or a combination of such conditions.

The hydrophobic nature of the wrapper can also prevent or reduce the incidence of deformation or disintegration of the tobacco rod of a smoking article where moisture interacts with the wrapper. When water penetrates the surface and is absorbed, the structure of the wrapper is weakened, effectively lowering the tensile strength of the wrapper and leading to easy tearing or collapse of the wrapper or tobacco substrate. An abundance of moisture in the external environment includes storing or consuming the smoking article in a wet environment or a humid environment where the humidity is very high (e.g., relative humidity greater than 70%, 80%, 90%, 95%, 99%). A wet environment is where the likelihood of direct contact with water is high. For example, by use of a wrapper having at least a hydrophobic outer surface, the incidence of damage to a smoking article can be reduced when it is consumed in the rain, at the beach, on a boat or ship, or under conditions which causes the consumer to perspire.

In some embodiments, the material or method to create the hydrophobic surface does not substantially reduce the permeability of the wrapper. Preferably, the reagent or method to create the hydrophobic surface reduces the permeability of the wrapper (as compared to the untreated wrapper material) by less than about 10% or less than about 5%.

The wrapper with the hydrophobic surface has a permeability of about 15 CORESTA units, about 20 CORESTA units or greater, about 30 CORESTA units or greater, or about 40 CORESTA units or greater. In some configurations, the permeability of wrapper with a hydrophobic surface is in a range from about 15 to 200 CORESTA units or from about 20 to 130 CORESTA units or from about 30 to 80 CORESTA units.

In various embodiments, the hydrophobic surface of the wrapper has a Cobb water absorption (ISO535:1991) value (at 60 seconds) of less than about 30 $g/m^2$, less than about 20 $g/m^2$, less than about 15 $g/m^2$, or less than about 10 $g/m^2$.

In various embodiments, the hydrophobic surface of the wrapper has a water contact angle of at least about 90 degrees, at least about 95 degrees, at least about 100 degrees, at least about 110 degrees, at least about 120 degrees, at least about 130 degrees at least about 140 degrees, at least about 150 degrees, at least about 160 degrees, or at least about 170 degrees. Hydrophobicity is determined by utilizing the TAPPI T558 om-97 test and the result is presented as an interfacial contact angle and reported in "degrees" and can range from near zero degrees to near 180 degrees. Where no contact angle is specified along with the term hydrophobic, the water contact angle is at least 90 degrees.

In preferred embodiments, the inner surface of the cigarette wrapper has a water contact angle of at least about 90 degrees, at least about 95 degrees, at least about 100 degrees, at least about 110 degrees, at least about 120 degrees, at least about 130 degrees at least about 140 degrees, at least about 150 degrees, at least about 160 degrees, or at least about 170 degrees. In some embodiments the outer surface of the cigarette wrapper has a water contact angle that is less (or less hydrophobic) than the inner surface, such as at least about 20 degrees less than the inner surface or at least about 30 degrees less than the inner surface. In some embodiments, the outer surface of the cigarette wrapper has a water contact angle of less than about 70 degrees, more preferably less than about 60 degrees. The outer surface may be less hydrophobic than the inner surface in order to facilitate the subsequent processing of the outer surface, for example printing designs on the outer surface, printing treatments for reduced cigarette ignition propensity, or to make it more compatible with certain adhesives.

In other embodiments, the outer surface has a water contact angle that is substantially the same as the inner surface, or within about 20 degrees of the contact angle of the inner surface. In certain embodiments, only the inner surface is treated. In other embodiments, only the inner surface is rendered hydrophobic. In still other embodiments the outer surface has a water contact angle that is greater (or more hydrophobic) than the inner surface such as, at least about 20 degrees more than the inner surface. In certain embodiments, only the outer surface is treated. In other embodiments, only the outer surface is rendered hydrophobic.

The hydrophobic surface can be uniformly present along the length of the wrapper. In some configurations the hydrophobic surface is not uniformly present along the length of the wrapper. For example, the hydrophobic surface may be preferentially present on a portion of the wrapper adjacent to the filter element or mouth piece of the smoking article and not present on an upstream portion of the wrapper. Preferably, the hydrophobic surface is not present in the most upstream 25% portion of the wrapper, and more preferably not present in the most upstream 40% portion of the wrapper. In some embodiments the hydrophobic surface forms a pattern along all or a portion of the length of the wrapper.

In many embodiments the hydrophobic surface can be formed by printing reactant along the length of the wrapper. Any useful printing methods can be utilized. The reactant can include any useful hydrophobic groups that can be reacted to chemically bond to the wrapper material or pendent groups of the wrapper material.

The hydrophobic surface can be formed with any suitable hydrophobic reactant or hydrophobic group. The hydrophobic reactant is preferably chemically bonded to the wrapper or pendent groups of the wrapper material. In many embodiments the hydrophobic reactant is covalently bonded to the wrapper or pendent groups of the wrapper material. For example, the hydrophobic reactant is chemically or covalently bonded to pendent groups of the cellulosic material forming the wrapper. In other embodiments, the hydrophobic reactant is ionicly bonded to the wrapper or pendent groups of the wrapper material. A chemical bond between the wrapper and the hydrophobic reactant can form hydrophobic groups that are securely attached to the wrapper material than simply disposing a coating of hydrophobic material on the wrapper surface. At the same time chemically bonding the hydrophobic reactant rather than providing a coating of hydrophobic material can allow the permeability of the wrapper to be better maintained since a coating tends to cover or block pores in the wrapper. Chemically bonding hydrophobic groups to the wrapper can reduce the amount of material required to render the surface of the wrapper hydrophobic.

The hydrophobic reactant can be produced from any suitable reagent. The reagent may be a hydrophobic reactant that includes a fatty ester group or fatty acid group, or a mixture thereof. The fatty ester group or fatty acid group or mixture thereof can be saturated or unsaturated, or a mixture of saturated or unsaturated. A fatty acid group (such as a fatty acid halide) can react with pendent hydroxyl groups of the cellulosic material to form a ester bond covalently bonding the fatty acid to the cellulosic material. In essence, these reactions with the pendant hydroxyl groups can esterify the cellulosic material.

The fatty ester group or fatty acid group preferably includes a $C_{12}$-$C_{30}$ alkyl (an alkyl group having from 12 to 30 carbon atoms), or more preferably a $C_{14}$-$C_{24}$ alkyl (an alkyl group having from 14 to 24 carbon atoms). In preferred embodiments, the hydrophobic reactant includes a fatty acid halide, such as, a fatty acid chloride including palmitoyl chloride, stearoyl chloride or behenoyl chloride, for example. The reaction between fatty acid chloride and cellulose results in fatty acid cellulose esters and hydrochloric acid.

Any suitable method can be utilized to chemically bond the hydrophobic reactant or group to the wrapper. As one example, an amount of hydrophobic reagent (solvent free) is deposited at the surface of paper at controlled temperature, for example, droplets of the reagents forming 20-micrometer regularly-spaced circles on the surface. The control of the vapour tension of the reagent will promote the propagation of the reaction by diffusion with the formation of ester bonds between fatty acid and cellulose while continuously withdrawing acid chloride. The esterification of cellulose is in some cases based on the reaction of alcohol groups or pendent hydroxyl groups of cellulose with an acyl halide compound, such as fatty acid chloride. The temperature that can be used to heat the hydrophobic reactant depends on the chemical nature of the reactant and for fatty acid halides, it ranges from about 120° C. to about 180° C.

The hydrophobic reactant can be applied to the wrapper in any useful amount or basis weight. In many embodiments the basis weight of the hydrophobic reactant is less than about 3 grams per square meter, less than about 2 grams per square meter, or less than about 1 gram per square meter or in a range from about 0.1 to about 3 grams per square meter, from about 0.1 to about 2 grams per square meter, or from about 0.1 to about 1 gram per square meter. The hydrophobic reactant can be printed on the wrapper surface and define a uniform or non-uniform pattern.

Preferably the hydrophobic wrapper is formed by reacting a fatty ester group or a fatty acid group with pendent hydroxyl groups on the cellulosic material of the wrapper to form a hydrophobic surface of the wrapper. The reacting step can be accomplished by printing a fatty acid halide (such as chloride, for example) which provides the fatty ester group or a fatty acid group to chemically bond with pendent hydroxyl groups on the cellulosic material of the wrapper to form a hydrophobic surface of the wrapper. The printing step can deposit discrete islands of reactant forming a uniform or non-uniform pattern of hydrophobic areas on the surface of the wrapper. The uniform or non-uniform pattern of hydrophobic areas on the wrapper can be formed of at least about 100 discrete hydrophobic islands, at least about 500 discrete hydrophobic islands, at least about 1000 discrete hydrophobic islands, or at least about 5000 discrete hydrophobic islands. The discrete hydrophobic islands can have any useful shape such as a circle, rectangle or polygon. The discrete hydrophobic islands can have any useful average lateral dimension. In many embodiments the discrete hydrophobic islands have an average lateral dimension in a range from 5 to 100 micrometres, or in a range from 5 to 50 micrometers.

Preferably, the hydrophobic wrapper is disposed about a tobacco substrate of an aerosol-forming substrate for a heated smoking article. The hydrophobic wrapper can reduce the absorption of compounds onto the wrapper as air is drawn through the heated smoking article.

In many embodiments the overall length of the smoking article is between about 70 mm and about 130 mm. In some embodiments the overall length of the smoking article is about 85 mm. The external diameter of smoking article can be between about 5.0 mm and about 8.5 mm, or between about 5.0 mm and about 7.1 mm for slim sized smoking articles or between about 7.1 mm and about 8.5 mm for regular sized smoking articles. The overall length of the filter of the smoking article can be between about 18 mm and about 36 mm. In some embodiments the overall length of the filter is about 27 mm.

The resistance to draw (RTD) of the smoking articles and the filters of the present disclosure can vary. In many embodiments the RTD of the smoking article with the filter is between about 50 to 130 mm $H_2O$. The RTD of a smoking article with the filter refers to the static pressure difference between the two ends of the specimen when it is traversed by an air flow under steady conditions in which the volumetric flow is 17.5 millilitres per second at the output end. The RTD of a specimen can be measured using the method set out in ISO Standard 6565:2002 with any ventilation blocked.

In one or more embodiments, smoking articles according to the present disclosure may be packaged in containers, for example in soft packs or hinge-lid packs, with an inner liner coated with one or more flavourants.

All scientific and technical terms used herein have meanings commonly used in the art unless otherwise specified. The definitions provided herein are to facilitate understanding of certain terms used frequently herein.

The term "hydrophobic" refers to a surface exhibiting water repelling properties. One useful way to determine this is to measure the water contact angle.

The "water contact angle" is the angle, conventionally measured through the liquid, where a liquid/vapour interface meets a solid surface. It quantifies the wettability of a solid surface by a liquid via the Young equation.

The term "smoking article" is used herein to indicate cigarettes, cigars, cigarillos and other articles in which a smokable material, such as a tobacco, is lit and combusted to produce smoke, The term "smoking article" also includes an aerosol-generating article in which an aerosol comprising nicotine is generated by heat without combusting the aerosol-forming substrate, such as tobacco substrate.

The term "aerosol-generating article" is used herein to refer to smoking articles that are not cigarettes, cigars, cigarillos, or that combust a tobacco substrate to produce smoke. Smoking articles according to the invention may be whole, assembled smoking devices or components of smoking devices that are combined with one or more other components in order to provide an assembled device for producing an aerosol, such as for example, the consumable part of a heated smoking device.

Typically, an aerosol-generating article comprises: a heat source; an aerosol-forming substrate (such as a tobacco substrate); at least one air inlet downstream of the aerosol-forming substrate; and an airflow pathway extending between the at least one air inlet and the mouth-end of the article. In various embodiments, the aerosol-forming substrate, the airflow pathway, and/or the mouthpiece can be circumscribed by a hydrophobic wrapper. The heat source is preferably upstream from the aerosol-forming substrate. The heat source may be a combustible heat source, a chemical heat source, an electrical heat source, a heat sink or any combination thereof. The heat source may be an electrical heat source, preferably shaped in the form of a blade that can be inserted into the aerosol-forming substrate. Alternatively, the heat source may be configured to surround the aerosol-forming substrate, and as such may be in the form of a hollow cylinder, or any other such suitable form. Alternatively, the heat source is a combustible heat source. As used herein, a combustible heat source is a heat source that is itself combusted to generate heat during use, which unlike a cigarette, cigar or cigarillo, does not involve combusting the tobacco substrate in the smoking article. Preferably, such a combustible heat source comprises carbon and an ignition aid, such as a metal peroxide, superoxide, or nitrate, wherein the metal is an alkali metal or alkaline earth metal.

The term "tobacco substrate" is used herein to indicate the portion of the smoking article that includes tobacco or tobacco cut filler. The tobacco substrate can be connected to the mouthpiece or filter in an end-to-end relationship, as further discussed below.

The term "mouthpiece" is used herein to indicate the portion of the smoking article that is designed to be contacted with the mouth of the consumer. The mouthpiece can be the portion of the smoking article that includes the filter, or in some cases the mouthpiece can be defined by the extent of the tipping paper. In other cases, the mouthpiece can be defined as a portion of the smoking article extending about 40 mm from the mouth end of the smoking article, or extending about 30 mm from the mouth end of the smoking article.

The term "tobacco cut filler" is used herein to indicate tobacco material that is predominately formed from the lamina portion of the tobacco leaf. The terms "tobacco cut filler" is used herein to indicate both a single species of *Nicotiana* and two or more species of *Nicotiana* forming a tobacco cut filler blend.

The terms "upstream" and "downstream" refer to relative positions of elements of the smoking article described in relation to the direction of mainstream smoke as it is drawn from a tobacco rod and through the filter and mouthpiece.

The term "mainstream smoke" is used herein to indicate smoke produced by combustible smoking articles, such as cigarettes, and aerosols produced by non-combustible smoking articles as described above. Mainstream smoke flows through the smoking article and is consumed by the user.

The term "tar" refers to the particulate matter portion of mainstream smoke.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates otherwise.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits under certain circumstances. However, other embodiments may also be preferred under the same or other circumstances. Furthermore, the recitation of one or more preferred embodiments does not imply that other embodiments are not useful, and is not intended to exclude other embodiments from the scope of the disclosure, including the claims.

The invention will now be further described with reference to the figures in which:

FIG. 1 is a schematic perspective view of an embodiment of a partially unrolled smoking article with the filter exploded away from the tobacco substrate.

FIG. 2 is a cross-sectional schematic view of the wrapper and tobacco substrate interface, with similar numbers referring to the same or similar components discussed and described with regard to FIG. 1.

Figure 1:
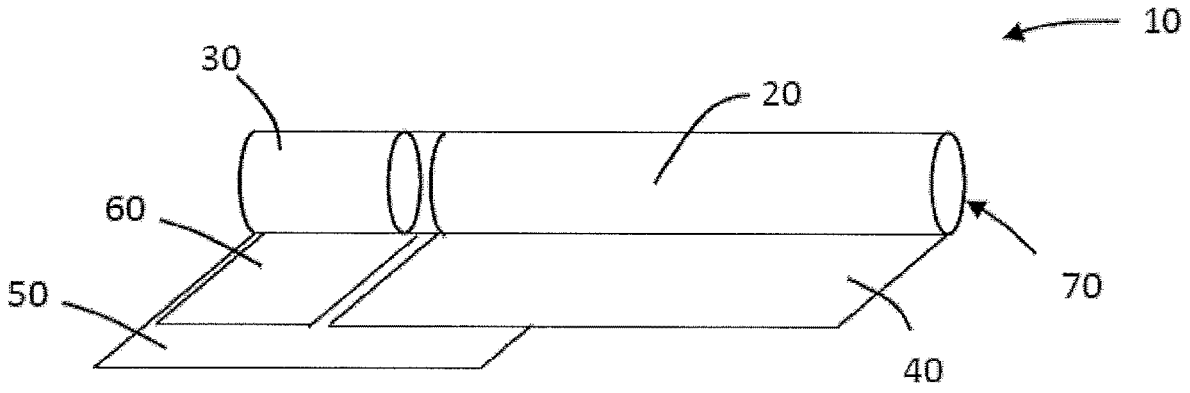
FIG. 1 is a schematic perspective view of an embodiment of a partially unrolled smoking article with the filter exploded away from a tobacco substrate.
Figure 2:
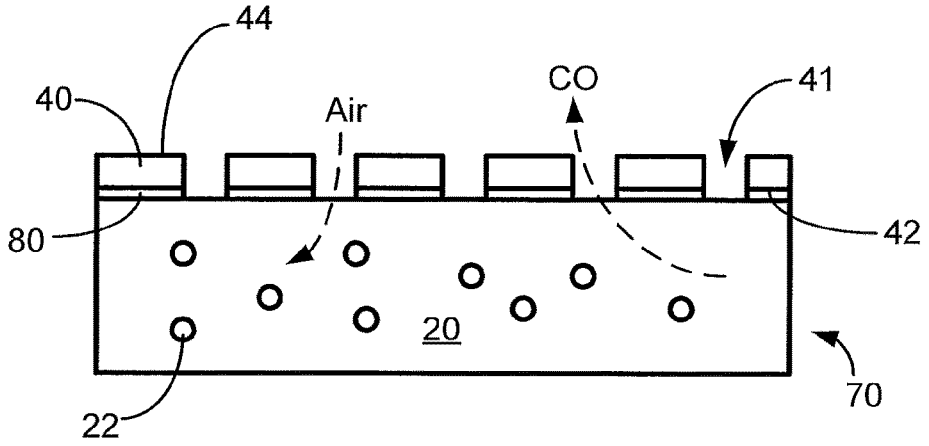
FIG. 2 is a cross-sectional schematic view of a wrapper and tobacco substrate interface.

The smoking articles depicted in FIGS. 1-2 illustrate one or more embodiment of smoking articles or components of smoking articles described above. The schematic drawings are not necessarily to scale and are presented for purposes of illustration and not limitation. The drawings depict one or more aspects described in this disclosure. However, it will be understood that other aspects not depicted in the drawings fall within the scope and spirit of this disclosure.

Referring now to FIG. 1, a smoking article 10, in this case a cigarette is depicted. The smoking article 10 includes a tobacco substrate 20, such as a tobacco rod, and a mouth end filter segment 30 and a lit end tip 70. The filter segment 30 is illustrated as being exploded away from the tobacco substrate 20, however it is understood that the filter segment 30 can abut the tobacco substrate 20 in the finished smoking article 10. The depicted smoking article 10, includes a plug wrap 60 that circumscribes at least a portion of the filter segment 30 and wrapper 40 that circumscribes at least a portion of the tobacco substrate 20. Tipping paper 50 or other suitable wrapper circumscribes the plug wrap 60 and a portion of the wrapper 40 as is generally known in the art. The wrapper 40 includes a hydrophobic surface.

FIG. 2 illustrates the interface of the wrapper 40 and the tobacco substrate 20. A hydrophobic reactant 80 forms a hydrophobic surface (of hydrophobic groups) on an inner surface 42 of the wrapper 40. The wrapper 40 has an outer surface 44 opposing the inner surface 42. The hydrophobic groups 80 inhibits the deposition of tar or water 22 to maintain the open pores 41 in the wrapper 40 and permeability of the cigarette wrapper 40. This sustains the CO diffusion out of the wrapper 40 or air dilution into the wrapper 40 as the tobacco substrate 20 is consumed and can reduce CO in mainstream smoke.

EXAMPLE

Untreated paper wrapper was supplied by Delfort as a bobbin with 30 cm web width:

E1045 WOO 25.0 g (Trade Designation)

Permeability—45 CU

Grammage—25 gsm

Thickness 43 microns

Hydrophobic treatment was carried out by direct deposition by gravure roll of 3 different concentrations per bobbin of stearoyl chloride ($C_{18}H_{35}ClO$—CAS 112-76-5). The hydrophobic reactant was heated temporarily up to 150° C. and printed onto the paper. Reactants in the form of dots or shapes (in this example circles and hexagons) of about 20 to 25 micrometres are transferred onto the surface of the paper. Concentrations were controlled by the number of dots or shapes per unit area and the depth of the wells on the gravure roller. The hydrophobic reactant was deposited at a quantity of 0.18 g/m$^2$ and a density of 5 moles/m$^3$. The processing time was 1.05 seconds with a penetration depth of 95 μm.

Water absorption was determined utilizing the standard Cobb method (ISO535:1991). This method determines the amount of water which is taken up by the paper within a specific time (within 60 seconds). The higher the Cobb value the higher the capacity of water absorption by the paper (that is, higher the affinity of the paper for water). The Cobb test gives reliable values if the paper is not fully soaked through with water. In these cases, the hydrophobic paper exhibited a Cobb measurement value (60 s) of less than 20 g/m$^2$, and even less than 10 g/m$^2$.

Trace amount of $C_{16}$ fatty acid was detected and is believed to be a contaminant within the stearoyl chloride.

| | Units | Control | A | B | C |
|---|---|---|---|---|---|
| Reagent Amount | $cm^3/m^2$ | 0 | 0.5 | 0.25 | 0.5 |
| Total fatty acid | $mg/m^2$ | 0.9 | 610.8 | 268.7 | 685.4 |
| $C_{16}$ OOH | $mg/m^2$ | 0.9 | 26.5 | 14.1 | 32.8 |
| $C_{18}$ OOH | $mg/m^2$ | 0 | 584.3 | 254.6 | 652.6 |
| Contact angle (30 s) | ° | 27 | 122.3 | 120.4 | 121.7 |
| Cobb Measurement | $g/m^2$ | 39.8 | 8 | 9 | 7.9 |

Visual inspection of a finished cigarette with a wrapper having a contact angle of about 120 degrees shows nearly fully formed droplets sitting on the wrapper surface.

Visual Appearance of the Wrapper in Aging Studies

During an accelerated shelf life study, cigarette samples were stressed under extreme conditions. Extreme conditions are created in a specific climatic simulation chamber as follows:

Desert Conditions (43° C. and 15% relative humidity) for three days;

Followed by Jungle conditions (32° C. and 85% relative humidity) for four days.

Based on previous studies, this cycle was repeated over 4 weeks to simulate 6 months in ambient temperate climate conditions (22° C. and 60% relative humidity).

The accelerated shelf life study enables one to determine potential alterations that could occur to the samples over-time: if some alterations occur over time, it can be assumed that the product will not be stable in real time. If no alteration is noticed, it is likely that the product will be stable in real time.

Tests were conducted with cigarettes that were placed in open packs with photographs taken after 2 weeks of accelerated shelf life study which simulate three months of ambient temperate climate conditions.

Figures 3A, 3B, 3C:
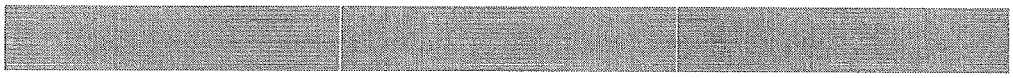
FIGS. 3A-3C illustrate three images of wrapper sample taken at time of zero.

FIG. 3A-3C illustrate three images of wrapper sample taken at time of zero. FIG. 3A is a control sample where no hydrophobic reactant was bonded to the wrapper. FIG. 3B is Sample A having 0.610 g/m2 of stearoyl chloride bonded to the wrapper. FIG. 3C is Sample A having 0.270 g/m2 of stearoyl chloride bonded to the wrapper.

Figures 4A, 4B, 4C:
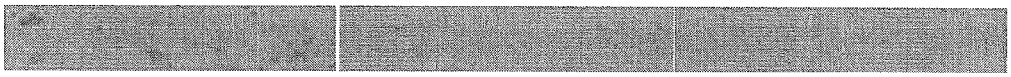
FIGS. 4A-4C illustrate three images of the wrapper samples shown in FIGS. 3A-3C obtained after two weeks (three months equivalent of ambient temperate climate conditions).

FIGS. 4A-4C illustrate three images of the wrapper samples shown in FIGS. 3A-3C obtained after two weeks (three months equivalent of ambient temperate climate conditions). Yellow to brown coloured spots, clearly visible to unaided human eyes, appear on the control (FIG. 4A) while few if any spots are visible in sample A (FIG. 4B) and sample B (FIG. 4B). The spots represent uneven changes in brightness, opacity as well as colour at various areas of the paper. The spots were caused by the transfer, over a simulated three-month period, of materials from the tobacco which penetrated and stained the paper. Consumers will likely reject cigarettes with such stains on the cigarette paper.

The invention claimed is:

1. A smoking article comprising:

a tobacco substrate;

a wrapper disposed about the tobacco substrate, wherein at least an inner or outer surface of the wrapper is hydrophobic via hydrophobic groups chemically bonded to the wrapper, the wrapper having a permeability of at least about 30 CORESTA units, wherein the hydrophobic groups comprise a fatty ester or a fatty acid group deposited in a pattern of discrete islands on the inner or outer surface and reacted with the wrapper, and wherein the inner or outer surface onto which the fatty ester or fatty acid group was deposited has a water contact angle of at least about 100 degrees.

2. A smoking article according to claim 1, wherein the inner surface of the wrapper, the outer surface of the wrapper, or both the inner and outer surface of the wrapper has a water contact angle of at least about 100 degrees.

3. A smoking article according to claim 1, wherein the wrapper comprises cellulosic material and a hydrophobic reactant covalently bonded to the cellulosic material.

4. A smoking article according to claim 2, wherein the wrapper has a basis weight in a range from about 20 to about 50 grams per square meter and the hydrophobic reactant has a basis weight in a range from about 0.1 to about 3 grams per square meter.

5. A smoking article according to claim 1, wherein the fatty ester group or fatty acid group comprises an alkyl group having from about 12 to 30 carbon atoms.

6. A smoking article according to claim 1, wherein the fatty ester group or fatty acid group is covalently bonded to a hydroxyl group of cellulose forming the wrapper.

7. A smoking article according to claim 1, wherein the fatty ester group or fatty acid group is derived from a fatty acid chloride.

8. A smoking article according to claim 7, wherein the fatty acid chloride comprises palmitoyl chloride, stearoyl chloride or behenoyl chloride.

9. A smoking article according to claim 1, wherein the wrapper exhibits a Cobb measurement value (60 s) of less than 20 $g/m^2$.

10. A smoking article according to claim 1, wherein the hydrophobic reactant reduces the permeability of the cigarette wrapper by less than about 10%.

11. A smoking article according to claim 1, wherein the tobacco substrate comprises an aerosol-forming substrate of a heated smoking article.

12. A method of forming a smoking article according to claim 1, wherein the wrapper comprises cellulosic material, the method comprising reacting a fatty acid chloride with the cellulosic material of the wrapper to form a hydrophobic surface of the wrapper.

13. A method according to claim 12 wherein the reacting step comprises printing fatty acid chloride, which provides a fatty ester group or a fatty acid group that bonds with pendent hydroxyl groups on the cellulosic material of the wrapper to form a hydrophobic surface of the wrapper.

14. A smoking article according to claim 3, wherein the wrapper has a basis weight in a range from about 20 to about 50 grams per square meter and the hydrophobic reactant has a basis weight in a range from about 0.1 to about 3 grams per square meter.

15. A smoking article according to claim 4, wherein the hydrophobic reactant comprises a fatty ester group or a fatty acid group.

16. A smoking article according to claim 5, wherein the fatty ester group or fatty acid group is covalently bonded to a hydroxyl group of cellulose forming the wrapper.

17. A smoking article according to claim 6, wherein the fatty ester group or fatty acid group is derived from a fatty acid chloride.

18. A method according to claim 12 wherein reacting step comprises reacting palmitoyl chloride, stearoyl chloride or behenoyl chloride to bond with pendent hydroxyl groups on the cellulosic material of the wrapper to form a hydrophobic surface of the wrapper.

* * * * *